US009629453B2

(12) United States Patent
Whittaker et al.

(10) Patent No.: US 9,629,453 B2
(45) Date of Patent: Apr. 25, 2017

(54) WALL CALENDAR STAND

(76) Inventors: Charles Jeffrey Whittaker, Belmont, CA (US); Richard Corwin Gong, Belmont, CA (US)

( * ) Notice: Subject to any disclaimer, the term of this patent is extended or adjusted under 35 U.S.C. 154(b) by 857 days.

(21) Appl. No.: 13/303,409

(22) Filed: Nov. 23, 2011

(65) Prior Publication Data

US 2012/0126088 A1 May 24, 2012

Related U.S. Application Data

(60) Provisional application No. 61/416,427, filed on Nov. 23, 2010.

(51) Int. Cl.

| | |
|---|---|
| ***A47B 97/00*** | (2006.01) |
| ***A47B 23/04*** | (2006.01) |
| ***G09D 3/00*** | (2006.01) |
| *B42D 5/04* | (2006.01) |

(52) U.S. Cl.

CPC ..... *A47B 23/043* (2013.01); *B42D 5/043* (2013.01); *G09D 3/00* (2013.01); *B42D 5/041* (2013.01)

(58) Field of Classification Search

USPC .... 248/441.1, 446, 447, 451, 452, 453, 454, 248/460, 463, 464, 465; 40/124.09, 40/124.17, 124.18, 748, 754

See application file for complete search history.

(56) References Cited

U.S. PATENT DOCUMENTS

| | | | | |
|---|---|---|---|---|
| 3,762,675 | A * | 10/1973 | Sankey | 248/464 |
| D258,782 | S * | 4/1981 | Bossons | D6/311 |
| 6,237,887 | B1 * | 5/2001 | Banner | 248/459 |
| 6,367,760 | B1 * | 4/2002 | Pagano | 248/451 |
| 6,641,171 | B2 * | 11/2003 | Lin et al. | 281/33 |
| 6,848,665 | B1 * | 2/2005 | Wu | 248/459 |
| 7,083,155 | B1 * | 8/2006 | Smartt | 248/441.1 |
| 7,188,818 | B2 * | 3/2007 | Chang | 248/460 |
| 7,240,443 | B2 * | 7/2007 | Nathanson et al. | 40/124.06 |
| 7,611,117 | B1 * | 11/2009 | Lang, Jr. | 248/452 |
| 7,818,904 | B2 * | 10/2010 | Wagner | 40/124.18 |
| 8,038,116 | B2 * | 10/2011 | Lee et al. | 248/463 |

* cited by examiner

*Primary Examiner* — Steven Marsh
(74) *Attorney, Agent, or Firm* — Buchanan Ingersoll & Rooney PC

(57) ABSTRACT

A stand, which includes a body portion comprising a relatively flat panel; a pair of angled support legs attachable vertically to a back side of the body portion; a slider arm mountable to the back side of the body portion of the stand, the slider arm having a means for connecting a medium to an upper portion of the slider arm; and a lip on a lower portion of a front side of the body portion, which holds at least one page of the medium in place.

19 Claims, 4 Drawing Sheets

WALL CALENDAR STAND

CROSS REFERENCE TO RELATED APPLICATION

This application claims priority to U.S. Provisional Patent Application Ser. No. 61/416,427, filed on Nov. 23, 2010, the entire content of which is incorporated herein by reference.

FIELD OF THE INVENTION

This invention relates to an adjustable stand, which makes it possible to free stand pictures, framed pictures, and papers of any size, and more particularly to standing a wall calendar on a flat horizontal surface.

BACKGROUND

Wall calendars are designed to hang on the wall by means of a hole in the top center of the calendar and a nail or hook which the user installs on the wall. Wall calendars also usually include pictures, which appeal to the user. The pictures are usually on the top half of the calendar with the calendar dates printed on the bottom half. Sometimes the calendar dates are printed on both the top and bottom half of the calendar. These calendars are often printed on thin paper with a hole in the top center of the calendar. The paper used is not heavy enough to stay upright against the wall with only the center hole hung on a nail or hook, which allows the top corners of the pages to droop or curl inward and downward towards the center of the calendar, thus obstructing the contents of the page and causing an unaesthetic look.

Accordingly, it would be desirable to have a stand, which can also be used to free stand pictures, framed pictures, papers or any other object that can fit onto it.

SUMMARY

In accordance with an exemplary embodiment, a stand comprises: a body portion comprising a relatively flat panel; a pair of angled support legs attachable vertically to a back side of the body portion; a slider arm mountable to the back side of the body portion of the stand, the slider arm having a means for connecting a medium to an upper portion of the slider arm; and a lip on a lower portion of a front side of the body portion, which holds at least one page of the medium in place.

The details of one or more embodiments of the disclosure are set forth in the accompanying drawings and the description below. Other features, objects, and advantages will be apparent from the description and drawings, and from the claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
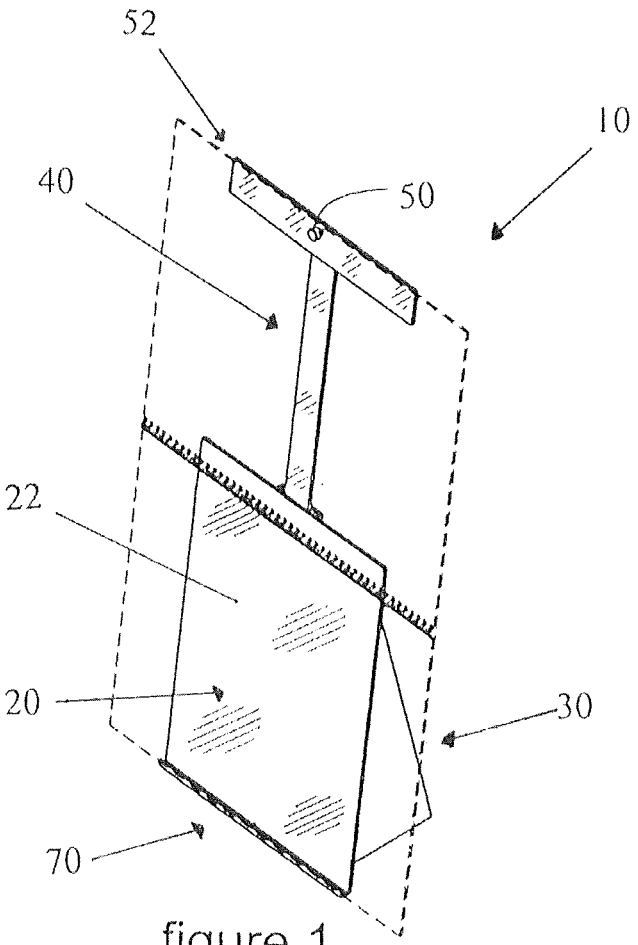
FIG. 1 is a perspective view of a calendar stand in an extended position from the front side in accordance with an exemplary embodiment.

FIG. 1 is a perspective view of a stand 10 in an extended position from the front side in accordance with an exemplary embodiment. As shown in FIG. 1, the stand 10 includes a body portion 20 comprising a relatively flat panel 22, and a pair of angled support legs 30 attachable vertically to a back side of the body portion 20. A slider arm 40 is mountable to the back side of the body portion 20 of the stand 10. In accordance with an exemplary embodiment, the slider arm 40 has a means 50 for connecting a medium (e.g., a calendar) to an upper portion 52 of the slider arm 40. A lip 70 on a lower portion of a front side of the body portion 20 holds at least one page of the medium in place. The lip 70 can be relatively square and/or rectangular, or alternatively, can have a slight curvature thereto, which forms a rounded channel and/or elliptical channel. In accordance with an exemplary embodiment, the flat panel 22 is approximately 5 inches to 24 inches in height and approximately 3 inches to 20 inches in width. The slider arm 40 is a T-shaped slider arm having a horizontal top bar and a vertical bar.

Figure 2:
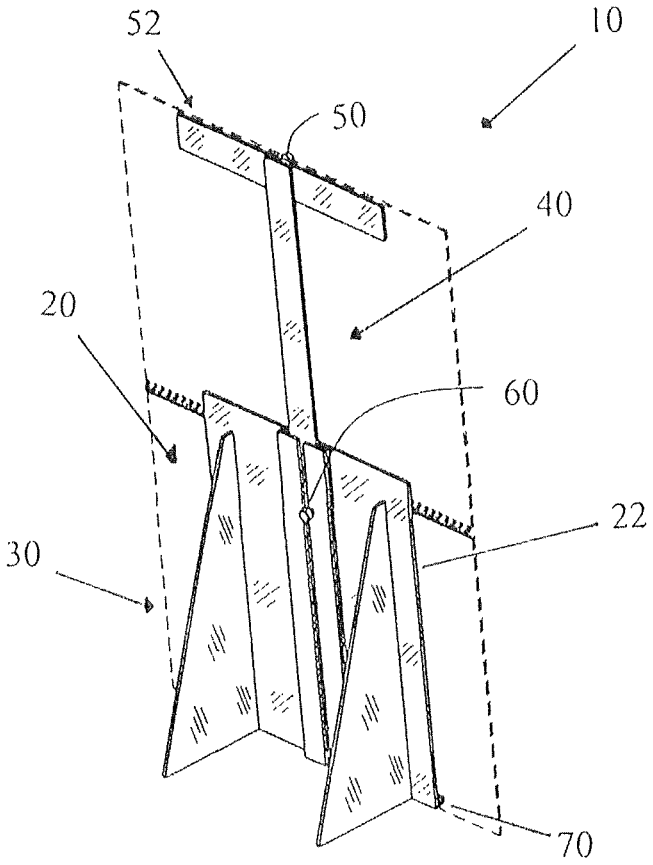
FIG. 2 is a perspective view of the calendar stand of FIG. 1 from the back side thereof.

As shown in FIG. 2, the pair of angled support legs 30 are approximately 5 inches in width and 13¼ inches in height. However, it can be appreciated that the pair of support legs 30 can be any suitable width and height, which can support the body portion 20 and the slider arm 40. In accordance with an exemplary embodiment, the pair of support legs 30 is preferably approximately 80 degrees to one another. However, it can be appreciated that in accordance with an exemplary embodiment, the pair of angle legs 30 is 5 degrees to 89 degrees to one another. The pair of legs 30 can be permanently attached to the body portion 20 of the stand 10, or alternatively, the pair of legs 30 can be detachable from the body portion 20 of the stand 10. In accordance with an alternative embodiment, rather than a pair of support legs 30, the body portion 20 can be supported by a single support leg 30, or alternatively, two or more support legs 30.

As shown in FIG. 2, the body portion 20 includes a channel on a back side of the body portion 20, such that the arm 40 can freely slide up and down. In accordance with an exemplary embodiment, the body portion 20 includes a permanently affixed guide on the back side of the body portion 20, such that the arm 40 can freely slide up and down. The stand 10 also includes a circular knob and/or nut 60, wherein once the desired height is achieved, the circular knob and/or nut 60 on a back side of the arm 40 can be tightened so the arm 40 stays firmly in place. It can be appreciated that the means for connection the medium to the top portion 52 of the arm 40 is on a front side of the top bar. In accordance with an exemplary embodiment, the means for connecting the medium to the top portion of the arm 40 is a screw. The stand 10 also includes a knob, which will thread onto the screw.

Figure 5:
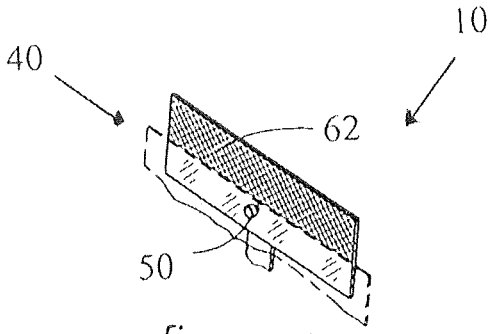
FIG. 5 is a perspective view of the top portion of the calendar stand in accordance with another exemplary embodiment.

As shown in FIGS. 1-5, the top bar of the T-shaped slider has an extended portion, which is located above the means for connecting the medium to the top portion of the arm 40. In addition, as shown in FIG. 5, the extended portion includes indicia 62 such as company names, logos, etc. In accordance with an exemplary embodiment, the medium is a calendar, a picture, framed or not framed, and/or any other object capable of standing up right.

In accordance with an exemplary embodiment, the calendar stand 10 includes a flat panel 22 of plastic ("body") approximately 10 inches wide and approximately 14½ inches tall. For different size "stands" 10, the body can be small as 5 inches or as great as 24 inches in height and as small as 3 inches or as great as 20 inches in width. It can be appreciated that these variations in calendar stand 10 sizes can make it possible to accommodate all sizes of calendars although the standard calendar stand 10 can be adjusted to fit most calendars.

Figure 3:
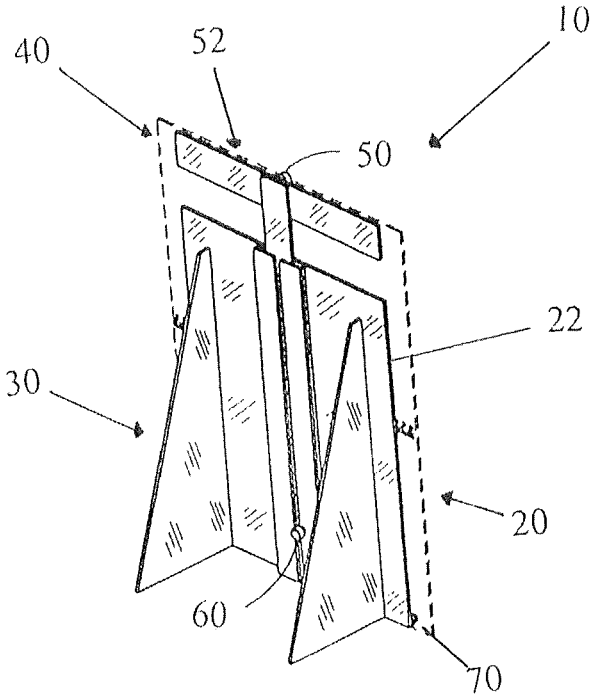
FIG. 3 is a perspective view of a calendar stand in an extended position from the back side in accordance with an exemplary embodiment.
Figure 4:
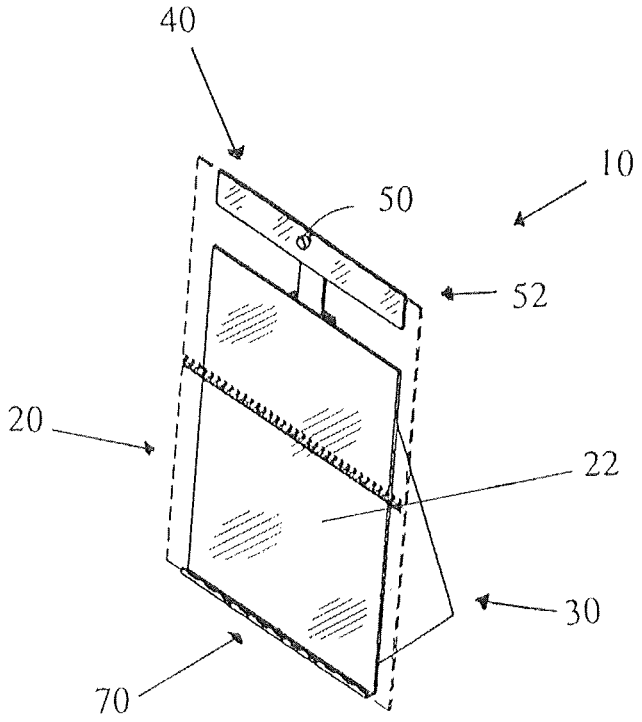
FIG. 4 is a perspective view of the calendar stand of FIG. 3 from the front side thereof.

The calendar stand 10 also preferably include located behind the body, a pair or at least two angled supports ("legs" 30), which are attachable vertically to the back side of the body of the stand 10 (see FIG. 3). In accordance with an exemplary embodiment, the standard size calendar stand legs 30 will be approximately 5 inches in width and 13¼ inches in height. The width and height of the "legs" 30 can be smaller or larger to accommodate the variations in "body" size. The legs 30 on a standard size calendar stand 10 are angled at approximately 80 degrees and will make it possible for the body portion 20 to stand on any flat surface. The angle of the legs 30 can be varied from 5 degrees to as much as 89 degrees if a stand 10 needs to have a different angle than the standard sized "stand" 10. The legs 30 can be permanently attached or detachable.

In accordance with an exemplary embodiment, mounted on the back side of the body will be a T-shaped slider ("arm") approximately 15¾ inches in height and approximately 1¼ inches in width. The arm 40 fits directly into a permanently affixed guide/channel on the back of the body and can freely slide up and down. The sliding motion of the arm 40 makes it capable of being adjusted upward or downward thus making it possible to accommodate different sized calendars or other medium. Once the desired height is achieved, a permanently affixed circular knob/nut 60 on the back side of the arm 40 can be tightened so the arm 40 stays firmly in place. On the front side top of the T-shaped arm 40 there will be a screw. This is where the holes in the wall calendar will attach. In accordance with an exemplary embodiment, a small knob will be threadable onto the screw. When tightened, the knob will firmly hold the calendar pages in place. The top bar of the T-shaped slider will have several variations in height. The standard size and several extended sizes. The extended variations have greater height so that a portion of the arm 40 shows above the top edge of the calendar. It can be appreciated that in accordance with an exemplary embodiment, the extended portion 52 can be used to engrave company names, logos, sayings, etc., which can be seen above the top of the calendar stand 10.

In accordance with an exemplary embodiment, on the front side bottom of the body portion 20 there will also be a channel or lip 70. The lip 70 is preferably approximately 5/16 inches wide, and holds the bottom pages of the calendar in place. The lip 70 can be made as small as ⅛ inch to as large as 3 inches. Alternatively, a larger lip 70 can be used to make it possible for the stand 10 to accommodate and free stand framed pictures or larger objects. In accordance with an exemplary embodiment, the lip 70 can have any suitable shape, including but not limited to round, elliptical and/or the like. The lip 70 forms a square, rectangular, round and/or elliptical channel on the lower surface of the body portion 20 of the stand 10.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed is:

1. A stand comprising:

a body portion comprising a relatively flat panel;

a pair of angled support legs attachable vertically to a back side of the body portion;

a slider arm mountable to the back side of the body portion of the stand, the slider arm having a screw for connecting a medium to an upper portion of the slider arm, and wherein the screw for connecting the medium to the upper portion of the slider is centered on a front side of the slider arm; and a lip on a lower portion of a front side of the body portion, which holds at least one page of the medium in place.

2. The stand of claim 1, wherein the flat panel is approximately 5 inches to 24 inches in height and approximately 3 inches to 20 inches in width.

3. The stand of claim 1, wherein the slider arm is a T-shaped slider arm having a horizontal top bar and a vertical bar.

4. The stand of claim 1, wherein the pair of angled support legs are approximately 5 inches in width and 13¼ inches in height.

5. The stand of claim 1, wherein the pair of angle legs are approximately 80 degrees to one another.

6. The stand of claim 1, wherein the pair of angle legs are approximately 5 degrees to 89 degrees to one another.

7. The stand of claim 1, wherein the pair of legs are permanently attached to the body portion of the stand.

8. The stand of claim 1, wherein the pair of legs are detachable from the body portion of the stand.

9. The stand of claim 1, wherein the body portion includes a channel on a back side of the body portion, such that the arm can freely slide up and down.

10. The stand of claim 1, wherein the body portion includes a permanently affixed guide on a back of the body portion, such that the arm can freely slide up and down.

11. The stand of claim 1, comprising:

a circular knob and/or nut, wherein once the desired height is achieved, the circular knob and/or nut on a back side of the arm can be tightened so the arm stays firmly in place.

12. The stand of claim 1, further comprising a knob, which threads onto the screw.

13. The stand of claim 1, wherein the slider arm has an extended portion, which is located above the means for connecting the medium to the top portion of the arm.

14. The stand of claim 13, wherein the extended portion includes indicia.

15. The stand of claim 1, wherein the lip is a square channel.

16. The stand of claim 1, wherein the lip has a slight curvature thereto forming a rounded and/or elliptical channel.

17. A calendar stand comprising:

a calendar having a hole in a top center portion thereof; and a stand, comprising:

a body portion comprising a relatively flat panel;

a pair of angled support legs attachable vertically to a back side of the body portion;

a slider arm mountable to the back side of the body portion of the stand, the slider arm having a threaded screw with a knob for connecting the calendar to an upper portion of the slider arm, and wherein the threaded screw is centered on a front side of the slider arm; and a lip on a lower portion of a front side of the body portion, which holds at least one page of the calendar in place.

18. The stand of claim 17, comprising:

a channel on a back side of the body portion, such that the arm can freely slide up and down; and a circular knob and/or nut, wherein once the desired height is achieved, the circular knob and/or nut on a back side of the arm can be tightened so the arm stays firmly in place.

19. A calendar stand, comprising:

a calendar having a hole in a top center portion thereof; and a stand comprising:

a body portion comprising a relatively flat panel;

a pair of angled support legs attachable vertically to a back side of the body portion;

a slider arm mountable to the back side of the body portion of the stand, the slider arm having a means for connecting the hole of the calendar to an upper portion of the slider arm, and wherein the means for connecting the calendar to the upper portion of the slider is centered on a front side of the slider arm; and a lip on a lower portion of a front side of the body portion, which holds at least one page of the calendar in place.

* * * * *